United States Patent [19]

Gary

[11] 4,080,055

[45] Mar. 21, 1978

[54] HALF-TONE COLOR COPIER

[75] Inventor: Robert E. Gary, Sodus, N.Y.

[73] Assignee: Xerox Corporation, Stamford, Conn.

[21] Appl. No.: 697,902

[22] Filed: Jun. 21, 1976

[51] Int. Cl.[2] ..... G03G 15/01

[52] U.S. Cl. ..... 355/4; 96/45; 355/71

[58] Field of Search ..... 355/3 R, 4, 8, 11, 67, 355/71, 35–38; 96/116–118, 45

[56] References Cited

U.S. PATENT DOCUMENTS

| | | | |
|---|---|---|---|
| 3,517,596 | 6/1970 | Johnson et al. | 355/4 X |
| 4,012,137 | 3/1977 | Goren | 355/4 |

*Primary Examiner*—Richard L. Moses

*Attorney, Agent, or Firm*—J. J. Ralabate; C. A. Green; H. Fleischer

[57] ABSTRACT

An optical system in which successive color filtered light images pass through a screen positioned at discrete preselected angles. An un-filtered light image is transmitted through the screen with the screen being positioned at one of the preselected angles for the filtered light image.

15 Claims, 6 Drawing Figures

HALF-TONE COLOR COPIER

BACKGROUND OF THE INVENTION

This invention relates generally to electrophotographic printing, and more particularly concerns an optical system employed therein for forming a half-tone light image of an original document being reproduced.

Screening achieves the effect of tone graduation by means of dot size variations. In the highlight regions, the dots are small and increase in size through the intermediate shades until they merge together in the shadow regions. At the highlight end of the tone scale, there is complete whiteness, while at the shadow end, nearly solid blackness. This type of tone structure can be reproduced in an electrophotographic printing machine.

Many techniques have been developed to improve half-tone reproduction. Moire patterns are minimized by re-orienting the screen between successive single color half-tone patterns.

With the advent of color electrophotographic printing, screening techniques have been employed to improve copy quality. Multi-color electrophotographic printing is similar to black and white printing. The process of black and white electrophotographic printing is described in U.S. Pat. No. 2,297,691 issued to Carlson in 1942. In color electrophotographic printing, the light image is filtered producing successive single color light images of the original document. These colored light images expose a charged photoconductive surface to create successive single color electrostatic latent images thereon. Each single color electrostatic latent image is developed with toner particles complementary in color to the color of the filtered light image. The toner powder images are transferred from the electrostatic latent image to a sheet of support material, in superimposed registration with one another. This multi-colored powder image is permanently affixed to the sheet of support material forming a color copy thereon.

Half-tone screens are used in multi-color electrophotographic printing systems to enhance the copy being reproduced. The screen is interposed into the optical light path and successive single color light images are transmitted therethrough onto the charged photoconductive surface to record an image of dots. By proper angular positioning of the half-tone screen, moire patterns can be avoided. A minimum pattern is formed when a screen angle of 30° is used between successive images. Since screens comprise line rulings or dots along axis of 90° relative to one another, only three angles, separated by 30°, may be employed before the angles repeat. In four-color printing, two of the colors must be separated by an angle other than 30°. Generally, inasmuch as yellow is a light color, it is printed at a 15° angular separation between two other colors, generally cyan and magenta. Usually the screen angles are: black, 45°; magenta, 75°; yellow, 90°; and cyan, 105°. An error as small as 0.1° between screen angles or a slight misregistration between colors can cause moire patterns in areas where three or four colors print. U.S. Pat. No. 3,109,239 issued to Wicker et al. in 1963 discloses the use of half-tone screens wherein the screen angle is separated by 30°for red, blue and black color images. The yellow image is interposed between the black and blue images. Similarly, U.S. Pat. No. 3,381,612 issued to Lecha in 1968 teaches the concept of separating the cyan, magenta and black images by 30°while interposing the yellow image between the magenta and black images. However, none of the prior art references appear to solve the problem of extremely tight angular tolerances being required between screen angles, i.e., such as 0.1°. It has been found in three color printing that the angular tolerance between screen angles is not as critical as is the case for four color printing.

Accordingly, it is a primary object of the present invention to improve electrophotographic printing machines by reducing the angular tolerance requirement between successive different screen angles while minimizing moire patterns.

SUMMARY OF THE INVENTION

Briefly stated, and in accordance with the present invention, there is provided an optical system for projecting a light image of an original document onto a light sensitive member.

Pursuant to the features of the present invention, the optical system includes means for illuminating the original document, and means, in a light receiving relationship with the light rays transmitted from the original document, for forming a plurality of filtered light images having different colors and an un-filtered light image. A screen member is interposed in the optical light path so that the filtered and un-filtered light images pass therethrough. Means are provided for orienting the screen member at pre-selected angles. In this manner, each filtered half-tone light image is formed at a different screen angle, with the un-filtered half-tone light image being formed at substantially the same angle as one of the filtered half-tone light images.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment and method of use therefor, it will be understood that it is not intended to limit the invention to that embodiment or method of use. On the contrary, it is intended to cover all alternatives, modifications and equivalents as may be included within the spirit and scope of the invention as defined by the appended claims.

DETAILED DESCRIPTION OF THE INVENTION

Figure 1:
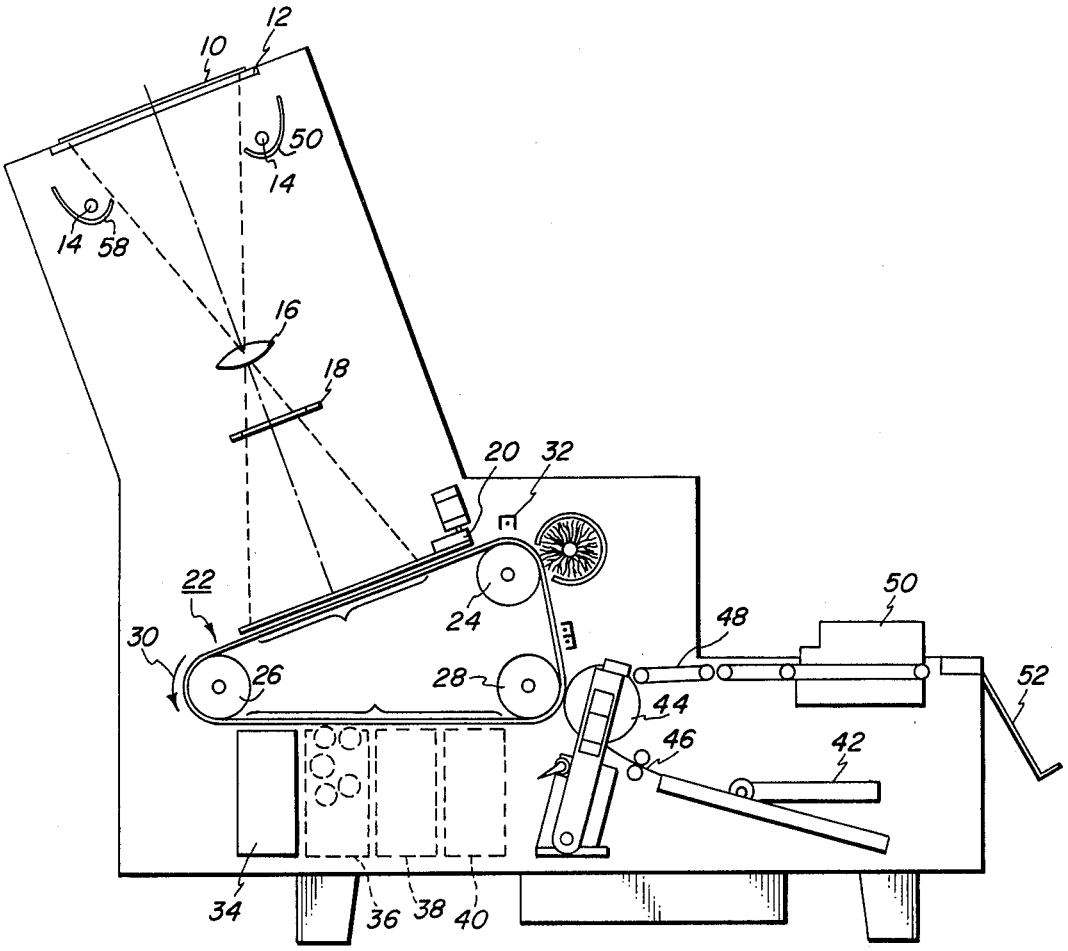
FIG. 1 is an elevational view depicting an electrophotographic printing machine incorporating the features of the present invention therein.

With continued reference to the drawings, FIG. 1 schematically illustrates a color electrophotographic printing machine employing the features of the present invention therein. In the drawings, like reference numerals have been used throughout to designate identical elements. The electrophotographic printing machine depicted in FIG. 1 is adapted to produce colored copies from a colored original document. The optical system of the printing machine is capable of creating successive half tone light images by utilizing a screen at discrete angles to minimize moire' patterns. This is achieved by rotating the screen member to different angles for each successive single color light image projected onto the charged photoconductive member. Inasmuch as the printing machine depicted in FIG. 1 is a four color printing machine, the un-filtered light image is projected onto the photoconductive surface at a screen angle substantially equal to the screen angle of one of the filtered light images. Although the optical system is particularly well adapted for use in a multi-color electrophotographic printing machine, it will become evident from the following description that it is equally well suited for use in a wide variety of printing machines and is not necessarily limited to the particular embodiment shown herein. For example, the original to be copied could be a color transparency instead of an opaque original. Moreover, in lieu thereof, the original could be a set of black and white separations projected in registration with one another.

Referring now to FIG. 1, an original document 10 is positioned upon platen 12 to be illuminated by light source or lamps 14. While upon platen 12, a program system for the electrophotographic printing machine introduces a control circuit to cause successive energization of lamps 14. Light rays reflected from original document 10 pass through a lens assembly 16. The light image is then transmitted through the respective separation filter of filter mechanism 18, thereby producing a light image corresponding to a single color of the color information areas contained within original document 10. The single color light image is then projected through screen member 20. Screen member 20 is indexed to discrete angles for each single color light image projected therethrough. Screen 20 is rotated 30° between successive single color light images. The half-tone light image is then projected onto the charged photoconductive surface of flexible belt 22 at exposure station A.

Endless belt 22 is entrained about three rollers 24, 26, and 28, respectively. The rollers are adapted to drive belt 22 at a constant rate in the direction of arrow 30. During the movement of belt 22, single color light images are successively flashed, full frame, upon the surface of belt 22. In addition to the single color light images, an unfiltered light image is also flashed full frame upon belt 20. Belt 20 has a layer of photoconductive insulating material, such as selenium on a conductive backing. Prior to exposure, belt 22 is sensitized by corona generating device 32.

Flash exposure of charged photoconductive belt 22 discharges the charge in the irradiates areas. In this way, electrostatic latent images are recorded on the belt corresponding to successive single color light images and an un-filtered light image. Filter mechanism 18 interposed selected color filters into the optical light path to produce a single color light image. Preferably, red, blue and green filters are employed. Each filter is successively interposed into the optical light producing a red light image, a green light image and a blue light image. In addition, an un-filtered light image is also formed. An un-filtered light image is formed when the light image does not pass through a color filter, i.e., filter mechanism 18 does not locate a filter in the optical light path. At this time, the window of the filter housing remains substantially transparent. The selected color filter operates on the light image to record an electrostatic latent image on photoconductive belt 22 corresponding to a pre-selected spectral region of the electromagnetic wave spectrum, hereinafter referred to as a single color electrostatic latent image.

With continued reference to FIG. 1, after an electrostatic latent image is recorded on belt 22, it continues to move in the direction of arrow 30. This rotates successive single color electrostatic latent images to development station B. At development station B, four individual developer units, generally designated by the reference numerals 34, 36, 38 and 40, respectively, are produced to develop each electrostatic latent image recorded on belt 22. Preferably, the developer units are all of a type generally referred to as magnetic brush developer units. A typical magnetic brush developer unit employs a magnetizable developer mix of carrier granules and toner particles. The developer mix is continually brought through a directional flux field to form a brush thereof. Each developer unit includes a developer roll electrically biased to the appropriate potential such that the toner particles are attracted from the carrier granules to the areas of photoconductive belt 22 having a greater charge thereon, i.e., the electrostatic latent image. The single color electrostatic latent image and the un-filtered electrostatic latent image recorded on photoconductive belt 22 are developed by bringing the brush of developer mix into contact therewith. Each of the respective developer mixes contain discretely colored toner particles corresponding to the complement of the wavelength of light transmitted through filter 18 or black toner particles for developing the un-filtered light image. Thus, a green filtered electrostatic latent image is rendered visible by depositing green absorbing magenta toner particles thereon. Blue and red latent images are developed with yellow and cyan toner particles, respectively. The un-filtered electrostatic latent image is developed with black toner particles. Successively developed electrostatic latent images are transported from belt 22 to a sheet of support material at transfer station C.

At transfer station C, a sheet of support material is moved in synchronism with photoconductive belt 22 to receive the developed images in registration with one another. At this station, there is provided a sheet transport mechanism 42 for advancing successive sheets to transfer roll 44. The sheet of support material is secured releasably on transfer roll 44 and rotates in a recirculating path therewith. This permits successive toner powder images to be transferred thereto in superimposed registration with one another. Thus, black, yellow, cyan and magenta toner powder images are transferred to the sheet of support material in superimposed registration with one another. The transfer of the toner powder images from photoconductive belt 22 to the sheet of support material is achieved by electrically biasing the transfer roll 44 to the proper polarity and magnitude.

After a plurality of toner powder images have been transferred, in registration with one another, to support material 46, the sheet is stripped from transfer roll 44. Conveyor 48 advances the sheet of support material with the toner powder images thereon to a fuser assembly, generally indicated by the reference numeral 50.

The multi-layered toner powder image on the sheet of support material is permanently affixed thereto in fuser 50. After fusing, the finished color copy is discharged into catch tray 52 enabling the machine operator to readily remove it therefrom.

Invariably, some residual toner particles remain on photoconductive belt 22 after the transfer of the toner powder images therefrom to support material 46. These residual toner particles are removed from photoconductive belt 22 as it passes through cleaning station D. At cleaning station D, a cleaning corona generating device 54 neutralizes the electrostatic charge remaining on the residual toner particles and that of photoconductive belt 22. The neutralized toner particles are then removed from photoconductive belt 22 by rotatably mounted brush 56 in contact therewith.

It is believed that the foregoing description is sufficient for purposes of the present application to illustrate the general operation of an electrophotographic printing machine embodying the teachings of the present invention therein.

Figure 2:
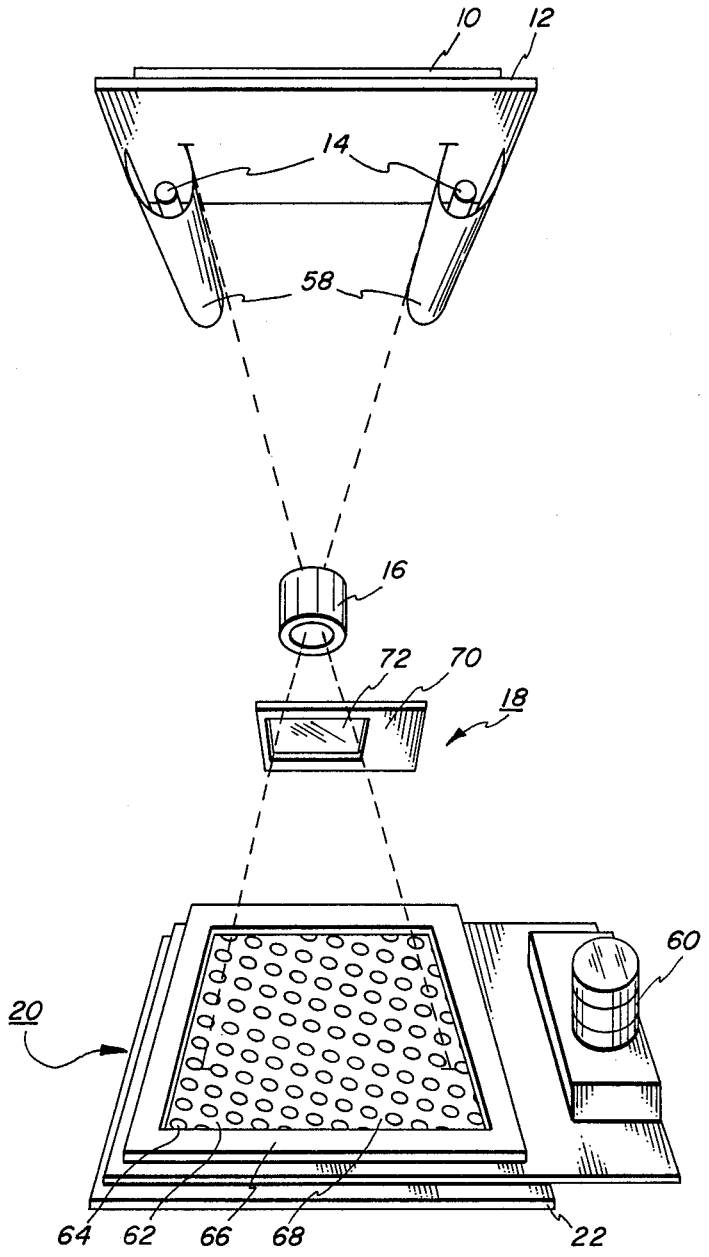
FIG. 2 is a perspective view of the FIG. 1 printing machine optical system.
Figure 3:
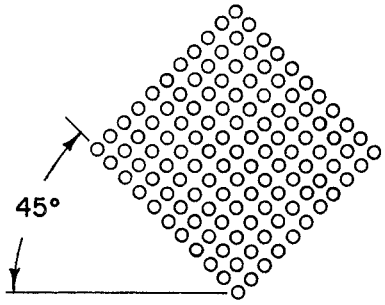
FIG. 3 is a preferred orientation of the screen member with a blue filter being interposed in the FIG. 2 optical system.

Referring now to FIG. 2, the optical system of the present invention is depicted therein in greater detail. The optical system includes a pair of lamps 14 adapted to be periodically activated by the circuitry associated with the printing machine when an original document 10 is disposed upon platen 14. Reflectors 58 are disposed beneath lamps 14 and are arranged to direct the light rays onto original document 10 providing full frame exposure. The foregoing system is a flash exposure system which is periodically excited in synchronism with the indexing of screen member 20. Screen member 20 is indexed by a stepping motor 60. Screen member 20 includes a transparent disc 62 having a plurality of dots 64 disposed thereon. The dots may be formed by a suitable chemical etching of photographic techniques on a transparent substrate. Transparent disc 62 is mounted in a housing 66 having a square window 68 therein. As disc 62 rotates, the square array of dots 64 thereon form different angles with the horizontal of housing window 68. In a preferred embodiment thereof, lamps 14 are activated when the square array of dots is at a 45° angle with respect to the horizontal of housing window 68 and a blue filter is interposed into the optical light path. Lamps 14 are again activated when the square array of dots is at a 75° angle with respect to the horizontal of the housing window 68 and a green filter is disposed in the optical light path. Once again, lamps 14 are activated when the square array of dots is at a 105° angle with respect to the horizontal of housing window 68 and a red filter is interposed into the optical light path. Finally, lamps 10 are activated when the square array of dots is at a 45° angle or a 135° angle when an un-filtered light image is projected therethrough. Thus, the dot pattern on the screen is at the same angular orientation for an unfiltered light image as it is for a blue filtered light image. In this way, the yellow toner powder image and the black toner powder images are formed at substantially the same screen angle, while the magenta and cyan powder images are separated therefrom. The angle of separation between each of the single color light image is 30°. Thus, light source 14 is activated when the dot pattern on the screen is at a $45° + n\,90°$, $75° + n\,90°$, and $105° + n\,90°$, where n is an integer which by the symmetry of the square array of dots is equivalent to 45°, 75°, and 105°.

Lens 16 is a six element split dagor type of lens having a front and back compound components with a diaphragm centrally located therebetween. The front lens component has three lens elements including, in the following order; a first lens element of positive power, a second lens element of negative power cemented to the first lens element, and a third element of positive power disposed between the second lens element and diaphragm. The back lens element also has three similar lens components positioned so that lens 16 is symmetrical. In a specific embodiment of the lens, the first lens element of the front component is a double convex lens, the second lens element a concave lens and the third lens element a convex-concave lens element. U.S. Pat. No. 3,592,531 issued to McCrobie in 1971 describes a suitable type of lens.

With continued reference to FIG. 2, a filter mechanism 18 comprises a housing 70 having a window 72 therein. Window 72 is positioned relative to lens 16 to allow the light reflected from original document 10 to pass therethrough. The bottom and top walls of housing 70 include a plurality of tracks which extend the entire width thereof. Each track has a filter therein. These tracks allow movement of the filters from an inoperative position to an operative position interposed in the window of the housing to allow light rays to pass therethrough. The individual filters are made from a suitable material such as coated glass. Three filters are employed in the FIG. 1 electrophotographic printing machine. These filters are biased into position in the window of the housing by individual extension springs. When inoperative, the filters are retained out of the line of the housing window by means of stop pins which extend up through an opening in the bottom of the housing member into the resepctive tracks of each filter. Solenoids, in association with each stop pin, retain the filters in the inoperative position. A selected filter is then inserted into the optical path of the housing window by activation of the appropriate solenoid. If no solenoid is activated, a filter is not interposed into the optical light path and the light image remains unfiltered. To insert a filter, the solenoid moves the stop pin corresponding to the selected filter downwardly from the track thereof. This permits the spring cooperating with the filter to pull the filter into the optical light path of the housing window. Once again, if an un-filtered light image is being formed, no filter is interposed into the housing window and a total light image rather than a partial light image is formed on a photoconductive belt 22. Preferably, filter mechanism 20 includes three filters, a blue filter, a red filter and a green filter. Each of the filters is associated with its respective toner particles, i.e., the complement of the color thereof to produce a subtractive system. As heretofore indicated, a green filtered light image is developed with magenta toner particles, a blue filtered light image with yellow toner particles, and a red filtered light image with cyan toner particles. A suitable filter mechanism is disclosed in U.S. Pat. No. 3,775,006 issued to Hartman et al. in 1973. An un-filtered light image is developed with black toner particles. As previously indicated, the square array of dots on disc 62 of screen member 20 is indexed through an angle of about 30° between each successive light image. An un-filtered light image is projected through screen member 20 when the square array of dots has been indexed through an angle of about 45°. A green filtered light image is projected through screen member 20 when the square array of dots has been rotated to about 75°, a red filtered light image when the square array of dots rotates through about 105°, and a blue filtered light image when the square array of dots has been indexed to an angle of about 45° or 135°. Thus, any two successive dot patterns have an angular separation of about 30°, with the dot pattern for the unfiltered light image or black toner particles being at the same angle as the dot pattern for the blue filtered light image or yellow toner particles. In FIGS. 3 through 6, inclusive, typical standard dot patterns, greatly magnified illustrate the specific angles from the horizontal.

Figure 4:
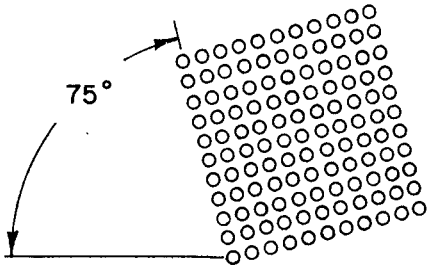
FIG. 4 is a preferred orientation of the screen member with a green filter being interposed in the FIG. 2 optical system.
Figure 5:
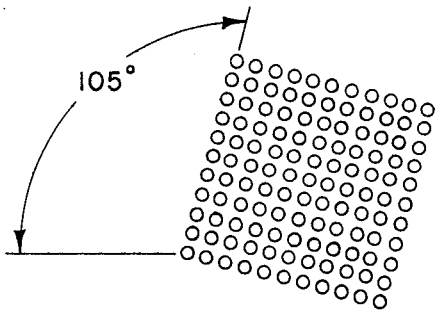
FIG. 5 is a preferred orientation of the screen member with a red filter being interposed in the FIG. 2 optical system.
Figure 6:
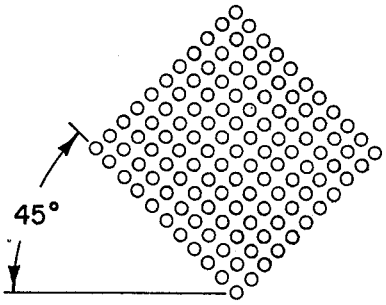
FIG. 6 is a preferred orientation of the screen member with an un-filtered light image being transmitted therethrough.

Turning now to FIGS. 3 through 6, inclusive, in operation, the square array of dots is periodically indexed in the window of the housing. A flash illumination system is periodically excited as the square array of dots reaches the pre-selected angular orientation relative to the horizontal, in the plane of rotation. Thus, when the square array of dots is rotated to an angle of 45° (as shown in FIG. 4), a blue filter is interposed into the optical light path. The illumination system is then activated producing a blue half-tone light image with the square array of dots being at a 45° angle. As the square array of dots is indexed to the next successive preselected angle, i.e., 75° (as shown in FIG. 4), a green filter is interposed into the optical light path. At this time, light source 14 is once again energized producing a green half-tone light image. A blue filter is interposed into the optical light path when the square array of dots is rotated through about a 105° angle (as shown in FIG. 5). At this time, light source 15 is again energized producing a red half-tone light image. Finally, the square array of dots is rotated to about 135° or 45° (as shown in FIG. 6). Once again, light source 14 is energized producing an un-filtered half-tone light image. These successive single color light images and the un-filtered light image irradiate the charged photoconductive surface producing successive electrostatic latent images which are developed with toner particles complementary in color to the color of the filtered light image and with black toner particles for the un-filtered light image. The toner powder images are transferred, in superimposed registration with one another, to a sheet of support material, and subsequently, fused thereto forming a color copy of the original document. Preferably, the black toner particles are transferred first to the sheet of support material with the yellow, magenta, and cyan toner particles being transferred subsequently thereto. In addition to employing a differently colored filter, a different neutral density filter may be associated with each of the differently colored optical filters to properly balance the intensity of illumination irradiating the charged photoconductive surface to produce the same contrast for differing light images.

In recapitulation, it is evident that the optical system utilized in the electrophotographic printing machine hereinbefore described produces half-tone light images wherein moire' patterns are minimized. The half-tone pattern is reoriented for each single color light image with the un-filtered light image being at the same angular orientation as one of the single color light images. In this manner, the tolerances between successive angular orientations is significantly reduced while the moire patterns are minimized.

While the optical system of the present invention has been described as being employed in a colored electrophotographic printing machine utilizing dry or powder toner, it is obvious to one skilled in the art that the invention is not necessarily so limited in its use. By way of example, the optical system may be employed in a printing machine utilizing liquid development or a photoelectrophoretic imaging system.

It is, therefore, evident that there has been provided in accordance with the present invention, an optical system that fully satisfies the objects, aims and advantages hereinbefore set forth. While this system has been described in conjunction with a specific embodiment and method of use therefor, it is evident that many alternatives, modifications and variations will be apparent to those skilled in the art. Accordingly, it is intended to embrace all such alternatives, modifications and variations as fall within the spirit and scope of the appended claims.

What is claimed is:

1. An optical system for projecting a light image of an original document onto a light sensitive member, including:

means for illuminating the original document;

means, in a light receiving relationship with the light rays transmitted from the original document, for forming a plurality of filtered light images having different colors and an un-filtered light image;

a screen member interposed in the optical light path so that the filtered and un-filtered light images pass therethrough; and means for orienting said screen member at preselected angles with each filtered half-tone light image being formed at a different pre-selected angle of said screen member and the un-filtered half-tone light image being formed at substantially the same angle as one of the filtered half-tone light images.

2. An optical system as recited in claim 1, wherein said forming means includes:

a filter mechanism comprising a plurality of differently colored filters; and means for activating said filter mechanism to interposed pre-selected colored filters in the optical light path when said orienting means positions said screen member at a pre-selected angle.

3. An optical system as recited in claim 2, wherein said filtering mechanism includes:

a blue filter;

a green filter; and a red filter.

4. An optical system as recited in claim 3, wherein:

said orienting means positions said screen member at a 45° angle when said filtered mechanism moves a blue filter into the optical light path;

said orienting means positions said screen member at a 75° angle when said filter mechanism moves a green filter into the optical light path;

said orienting means positions said screen member at a 105° angle when said filter mechanism moves a red filter into the optical light path; and said orienting means position said screen member at a 45° angle to transmit an un-filtered light image therethrough.

5. An optical system as recited in claim 4, wherein said screen member includes a substantially square array of dots thereon.

6. An electrophotographic printing machine for reproducing an original document, including:

a photoconductive member;

means for charging at least a portion of said photoconductive member to a substantially uniform level; and an optical system for projecting a light image of the original document onto the charged portion of said photoconductive member to record an electrostatic latent image thereon, said optical system comprising; means for illuminating the original document, means, in a light receiving relationship with the light rays transmitted from the original document, for forming a plurality of filtered light images having different colors and an un-filtered light image, a screen member interposed in the optical light path so that the filtered and un-filtered light images pass therethrough, and means for orienting said screen member at pre-selected angles with each filtered half-tone light image being formed at a different angle of the screen member and the un-filtered half-tone light image being formed at substantially the same angle as one of the filtered half-tone light images.

7. A printing machine as recited in claim 6, wherein the forming means of said optical system includes; a filter mechanism comprising a plurality of differently colored filters, and means for actuating said filter mechanism to interpose pre-selected colored filters in the optical path when said orienting means positions said screen member at a pre-selected angle.

8. A printing machine as recited in claim 7, wherein the filtering mechanism of said optical system includes; a blue filter, a green filter, and a red filter.

9. A printing machine as recited in claim 8, wherein: the orienting means of said optical system positions the screen member at a 45° angle when the filter mechanism moves a blue filter into the optical light path, the orienting means position the screen member at a 75° angle when the filter mechanism moves a green filter into the optical light path, the orienting means positions the screen member at a 105° angle when the filter mechanism moves a red filter into the optical light path, and the orienting means positions the screen member at a 45°angle to transmit an un-filtered light image therethrough.

10. A printing machine as recited in claim 9, wherein the screen member of said optical system includes a substantially square array of dots thereon.

11. A method of reproducing an original document in an electrophotographic printing machine, including the steps of:

charging at least a portion of a photoconductive member to a substantially uniform level;

illuminating the original document;

forming a plurality of filtered light images having different colors and an un-filtered light image from the light rays transmitted from the original document;

interposing a screen member in the optical light path so that the filtered and un-filtered light images which irradiate the charged portion of the photoconductive member to record thereon successive electrostatic latent images; and orienting the screen member at pre-selected angles with each filtered half-tone light image being formed at a different pre-selected screen angle and the un-filtered half-tone light image being formed at substantially the same angle as one of the filtered half-tone light images.

12. A method as recited in claim 11, wherein said step of forming includes the step of interposing successive differently colored filters in the optical light path with the screen being at different pre-selected angles.

13. A method as recited in claim 12, wherein said step of interposing includes the step of positioning sequentially a blue filter, a green filter, and a red filter in the optical light path.

14. A method as recited in claim 13, wherein said step of orienting includes the step of; indexing the screen to a 45° angle with a blue filter being in the optical light path, indexing the screen to a 75° angle with a green filter being in the optical light path, indexing the screen to a 105° angle with a red filter being in the optical light path, and indexing the screen to a 45° angle with an unfiltered light image being transmitted therethrough.

15. A method as recited in claim 14, further including the steps of:

developing the un-filtered latent image wih black tone particles, developing the blue filtered latent image with yellow toner particles, developing the green filtered latent image with magenta toner particles, and developing the red latent image with cyan toner particles;

transferring the black, yellow, magenta and cyan toner particles to a copy sheet, in superimposed registration with one another; and fixing substantially permanently the black, yellow, magenta, and cyan toner particles to the copy sheet forming a colored copy of the original document.

* * * * *